US005461842A

United States Patent [19]

Brizzi et al.

[11] Patent Number: 5,461,842

[45] Date of Patent: Oct. 31, 1995

[54] PACKING LINE FOR PRODUCING TWIN PACKETS

[75] Inventors: Marco Brizzi, Predosa; Antonio Gamberini, Bologna, both of Italy

[73] Assignee: G.D Societa' per Azioni, Bologna, Italy

[21] Appl. No.: 382,672

[22] Filed: Feb. 2, 1995

[30] Foreign Application Priority Data

Feb. 11, 1994 [IT] Italy ..... BO94A0054 U

[51] Int. Cl.[6] ..... B65B 11/28

[52] U.S. Cl. ..... 53/234; 53/136.1; 53/170; 493/416; 493/178

[58] Field of Search ..... 53/234, 136.1, 53/202, 170, 176; 493/178, 180, 416, 417, 419, 422

[56] References Cited

FOREIGN PATENT DOCUMENTS 973240 10/1964 United Kingdom .

WO79/00102 3/1979 WIPO .

*Primary Examiner*—Horace M. Culver
*Assistant Examiner*—Ed Tolan
*Attorney, Agent, or Firm*—Marshall, O'Toole, Gerstein, Murray & Borun

[57] ABSTRACT

On a packing line for producing twin packets, collars are fed successively by an oscillating conveyor arm into respective conveyor seats, each for housing two side by side half packets; the conveyor arm presenting two telescopically connected portions in turn presenting respective gripping members cooperating with respective main panels of the collar and the two telescopic portions being movable in relation to each other for folding accordion-fashion a central portion of the collar interposed between the two main panels.

17 Claims, 4 Drawing Sheets

PACKING LINE FOR PRODUCING TWIN PACKETS

BACKGROUND OF THE INVENTION

The present invention relates to a packing line for producing twin packets.

Here and hereinafter, the term "twin" packet is intended to mean a packet consisting of two half packets which present respective foil wrappings, are connected to a single collar presenting a central accordion portion interposed between the half packets, and are arranged side by side inside the same outer wrapping.

SUMMARY OF THE INVENTION

It is an object of the present invention to provide a packing line for producing twin packets, and which provides in a straightforward, low-cost manner for folding the collars into the aforementioned shape.

According to the present invention, there is provided a packing line for producing twin packets, each comprising two half packets and a single collar in turn comprising a central accordion portion interposed between the two half packets, and two main panels arranged contacting respective large lateral surfaces of the two half packets; the line comprising folding means cooperating successively with said collars for so folding them, from a flat configuration, as to form said central accordion portion; characterized in that said folding means comprise a first and second gripping member cooperating with the main panels of a respective collar; and actuating means for moving the two gripping members in relation to each other and in a given direction between a parted position corresponding to a distended configuration of said central portion, and an adjacent position corresponding to an accordion configuration of said central portion.

Said folding means preferably comprise a number of said gripping members of which said first and second gripping members are the central gripping members; said number of gripping members comprising a further two outer gripping members located on either side of the two central gripping members, and each cooperating with a respective wing projecting laterally from a respective said main panel.

According to a preferred embodiment of the above packing line, the line comprises conveyor means presenting a succession of pockets, each of which is designed to receive two side by side half packets and a collar, and travels with the conveyor means in a given direction through a first station for loading the collars, and a second station for loading the half packets; said folding means being movable to and from said first loading station, for feeding the collars successively to the respective said pockets.

Each pocket preferably comprises stiffening means cooperating with said central portion for maintaining it in said accordion configuration; and retaining means cooperating with said main panels of the respective said collar for maintaining them in a given fixed position in relation to the respective central accordion portion.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
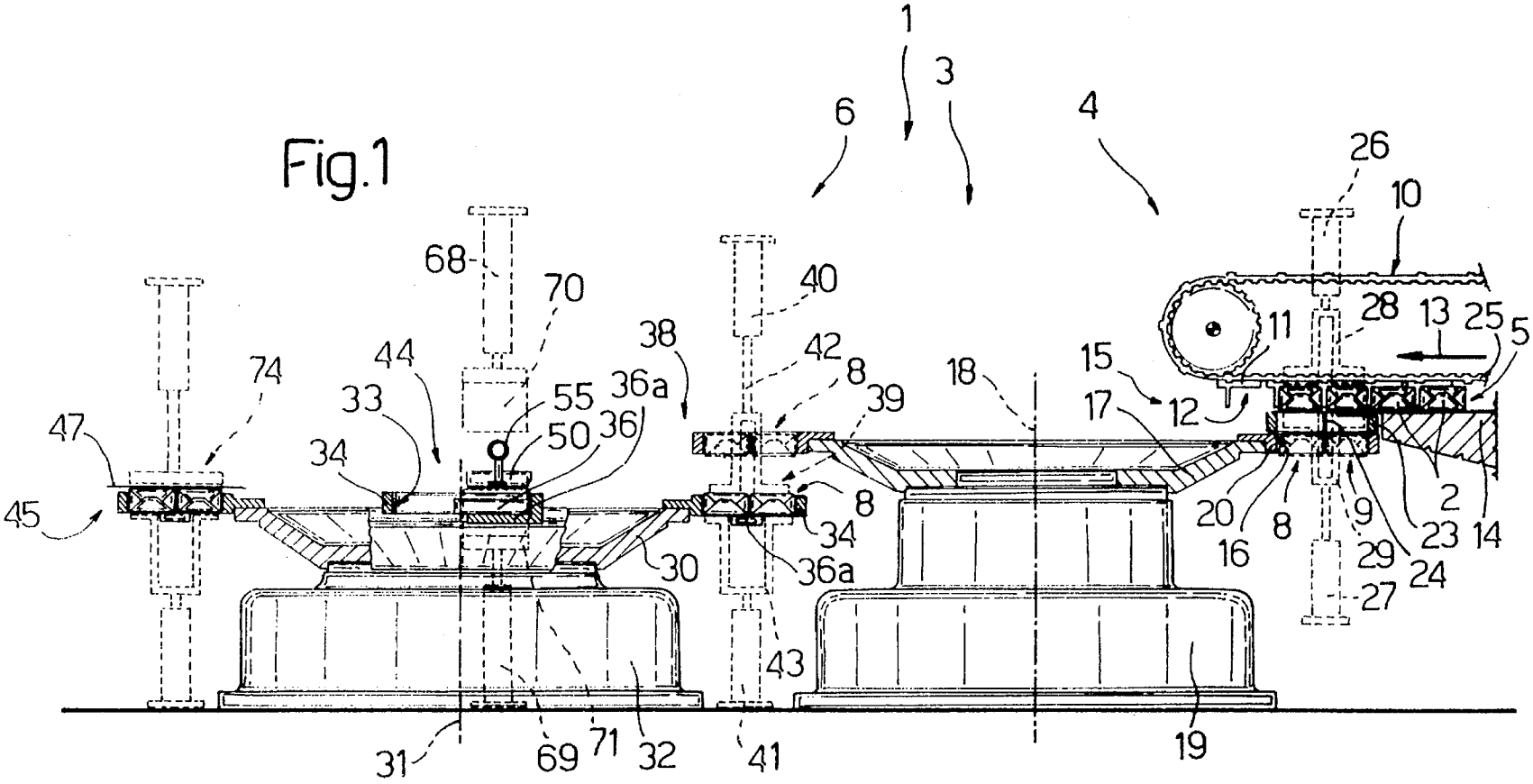
FIG. 1 shows a side view, with parts in section and parts removed for clarity, of a preferred embodiment of a wrapping line comprising a packing line in accordance with the teachings of the present invention.

Number 1 in FIG. 1 indicates a packing machine for producing twin packets (not shown), i.e. packets comprising two half packets 2 consisting of respective foil wrappings enclosing respective groups of ten cigarettes (not shown) arranged in two superimposed rows.

Machine 1 comprises a single wrapping line 3 in turn comprising an input portion 4 for forming a single succession 5 of half packets 2, an output portion (shown only partly) consisting of a packing line 6 for forming a succession of twin packets (not shown) from a single succession 7 of groups or pairs 8 of side by side half packets 2, and a pairing unit 9 interposed between input portion 4 and packing line 6, for successively forming pairs 8 by grouping the half packets 2 from input portion 4 into twos and successively feeding pairs 8 to packing line 6.

With reference to FIG. 1, input portion 4 of line 3 is substantially the same as the input portion of a standard-packet wrapping line (not shown), and comprises an output element consisting of a pocket conveyor 10 in turn comprising a succession of tracks 11 defining a succession of pockets 12 traveling in steps in direction 13 and facing a supporting plate 14. Each pocket 12 is designed to receive a half packet 2 with its longer longitudinal axis crosswise to direction 13, and its large lateral surface in sliding contact with plate 14.

Conveyor 10 presents an unloading station 15 located at the output end (in direction 13) of plate 14, extending over two pockets 12, and located over the path of the outer pockets 16 of a transfer wheel 17 constituting the input wheel of packing line 6. Wheel 17 rotates anticlockwise (in FIG. 2) about a vertical axis 18 perpendicular to direction 13, and comprises a central drum 19 from which pockets 16 project radially outwards. Each pocket 16 is defined by a substantially rectangular frame 20 lying in a substantially horizontal plane parallel to plate 14, and is divided into two half pockets 21, respectively indicated 21*a*, 21*b* and of the same size as pockets 12, by a partition 22 fitted to respective frame 20 and perpendicular to the radius of drum 19 through frame 20. Each frame 20 is fed in steps about axis 18, and is arrested at unloading station 15 with half pockets 21*a* and 21*b* positioned directly beneath two pockets 12 also arrested at station 15.

As shown in FIG. 1, pairing unit 9 comprises a fixed frame 23 substantially similar to frames 20 and presenting a central partition 24 similar to partitions 22 and defining, inside frame 23, two half pockets substantially similar to half pockets 21. Frame 23 is located at unloading station 15, between the path of frames 20 and the bottom branch 25 of conveyor 10.

Pairing unit 9 also comprises two actuating devices 26 and 27 located respectively above and below the plane of plate 14, and which respectively provide for moving a pusher 28 and a counterpusher 29 back and forth for transferring a pair 8 of half packets 2 from two adjacent pockets 12 on conveyor 10 to the two half pockets 21 of a frame 20 at unloading station 15.

Figure 2:
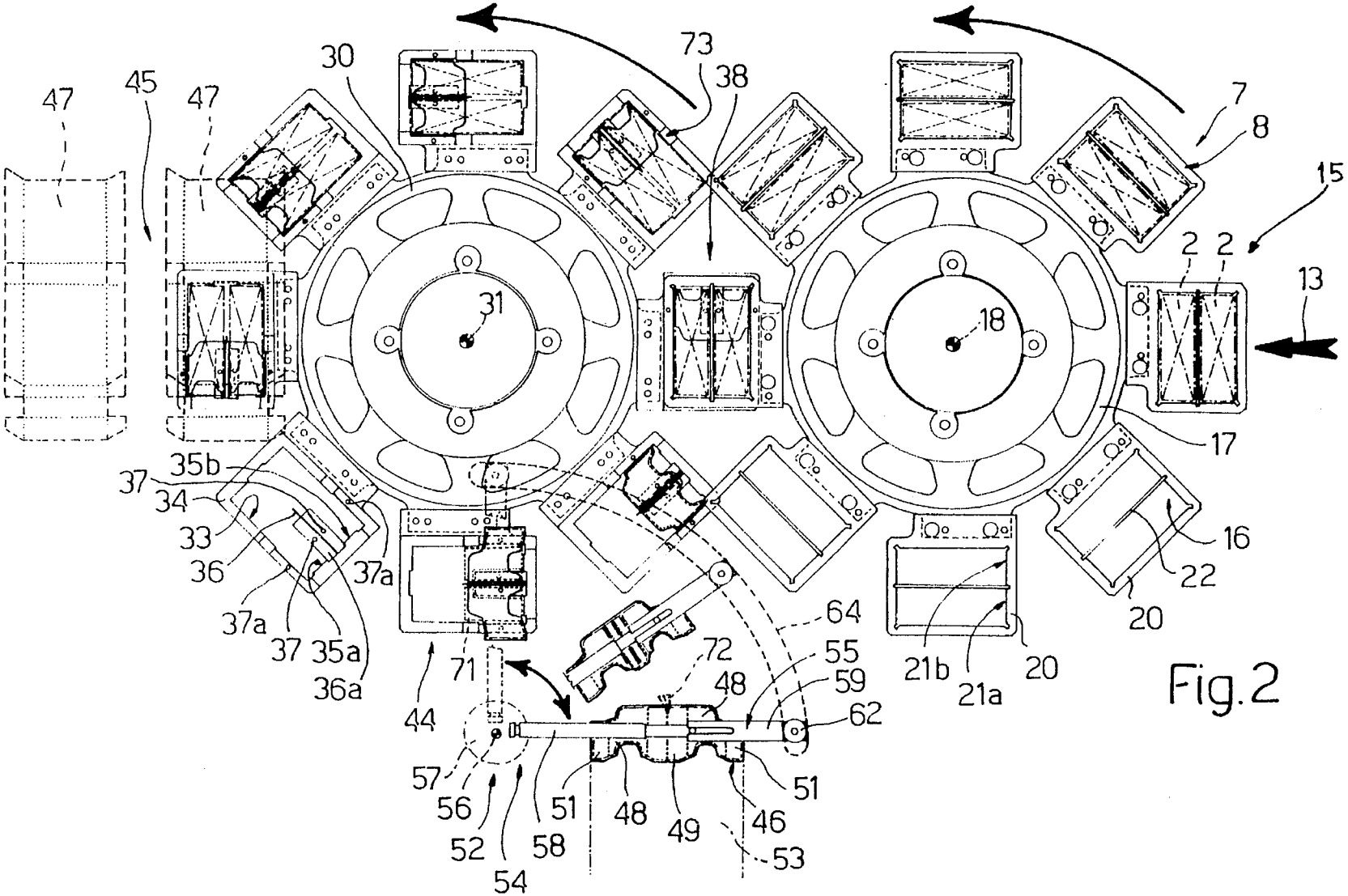
FIG. 2 shows a plan view of the FIG. 1 wrapping line.

Packing line 6 comprises a further wheel 30 rotating anticlockwise (in FIG. 2) about a vertical axis 31 parallel to axis 18, and comprising a central drum 32 from which pockets 33 project radially outwards. Each pocket 33 is defined by a substantially rectangular frame 34 similar to frames 20 and lying in a substantially horizontal plane parallel to that of frames 20, and is divided into two half pockets 35, respectively indicated 35*a*, 35*b* and of the same size as half pockets 21, by a partition 36 extending along only part of the length of frame 34 and in a direction perpendicular to the radius of drum 32 through frame 34. As shown in FIG. 2, partition 36 extends upwards from a base plate 36*a* integral with an end wall of frame 34 and presenting, on either side of partition 36, two suction holes 37 communicating in known manner (not shown) with a suction pump (not shown), together with a further two holes 37*a* formed in the top surface of frame 34 and aligned with and on either side of holes 37.

As wheel 30 rotates, frames 34 travel about axis 31 along a circular path, a portion of which extends, at transfer station 38, beneath a corresponding portion of the path traveled by frames 20 as wheel 17 is rotated about axis 18; and each frame 34, as it is fed in steps about axis 31, is arrested at transfer station 38 and positioned perfectly aligned with a frame 20 also arrested at station 38.

At station 38, packing line 6 comprises a transfer unit 39 similar to pairing unit 9 and in turn comprising two actuating devices 40, 41 respectively located over the path of frames 20 and beneath the path of frames 34, and which respectively provide for moving a pusher 42 and a counterpusher 43 back and forth for transferring a pair 8 of half packets 2 from respective half pockets 21 of a respective frame 20 arrested at station 38 to two respective half pockets 35 of a frame 34 also arrested at station 38.

In addition to transfer station 38, the path of frames 34 also extends through a first and second loading station 44 and 45 respectively located up- and downstream from transfer station 38 in the rotation direction of wheel 30. At stations 44 and 45, each frame 34 is supplied respectively with a double collar 46, and with a known flat blank 47 which is folded in known manner about a respective pair 8 of half packets 2 and a respective double collar 46 to form a twin packet (not shown).

Double collars 46 are of known type, and comprise two main panels 48 which are positioned coplanar and contacting the large lateral surfaces of the two half packets 2 in each pair 8, and which are separated by a central portion 49 comprising two panels which are folded accordion-fashion to form a central rib 50 perpendicular to the plane of main panels 48. Each double collar 46 also comprises two wings 51 projecting from the opposite edges of main panels 48 to those connected to central portion 49, and which are folded squarely and parallel to central rib 50, on the same side of main panels 48 as rib 50.

Collars 46 are fed into pockets 33 at loading station 44 by a supply device 52 which comprises a known conveyor 53 substantially perpendicular to the plane defined by axes 18 and 31, and a transfer device 54 for successively transferring collars 46 from the output end of conveyor 53 to station 44. Transfer device 54 comprises a conveyor arm 55 which is mounted for rotation about an axis 56 parallel to axis 31, is substantially perpendicular to axis 56, and, by means of a powered central hub 57, is swung roughly 90° between a first position wherein it is positioned over the output end of conveyor 53, and a second position wherein it is positioned at station 44 in time with a frame 34.

Figure 4:
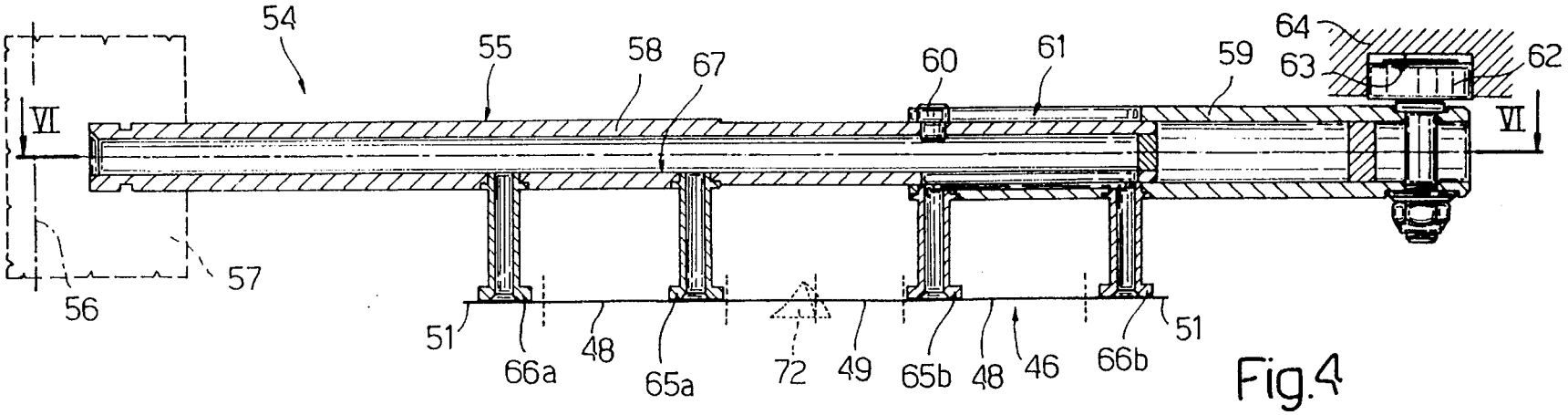
FIGS. 4 and 5 show sections along lines IV—IV and V—V in FIG. 3.
Figure 5:
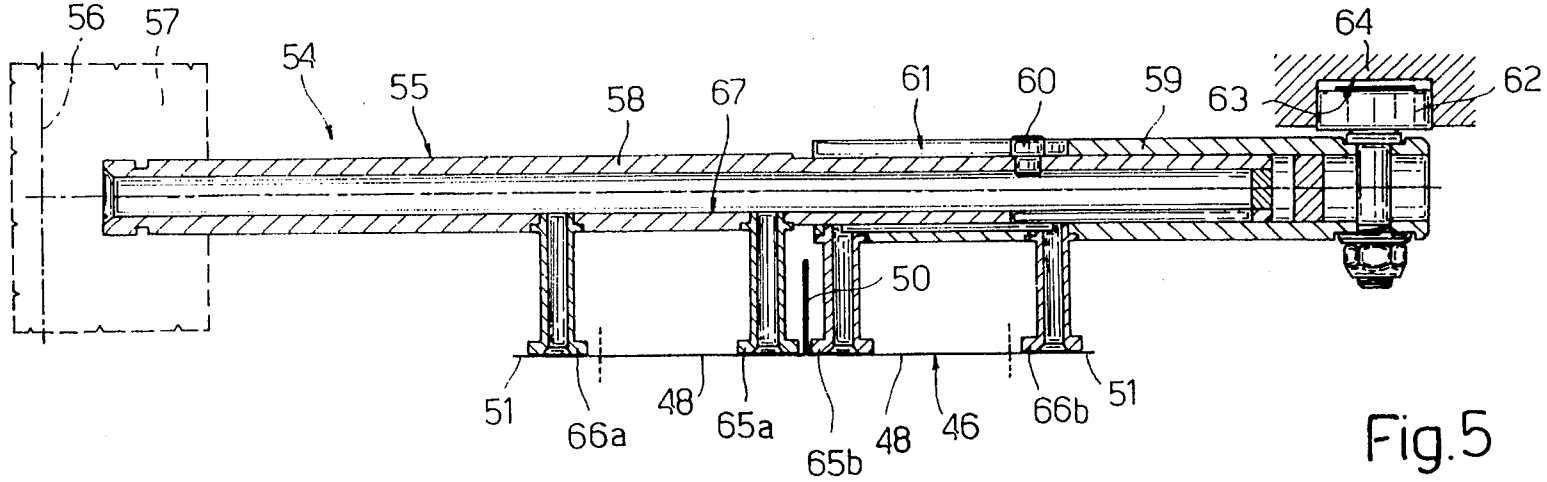

As shown in FIGS. 4 and 5, arm 55 is tubular, and comprises an inner portion 58 and an outer portion 59 connected telescopically to each other and made angularly integral by a radial pin 60 fitted to portion 58 and engaging in sliding manner an axial slot 61 formed in portion 59. Portion 58 presents one end connected integral with hub 57, and the other end engaged in sliding manner inside portion 59; while portion 59 presents, on the opposite end to that connected to portion 58, a tappet roller 62 engaging the substantially spiral-portion-shaped groove 63 of a face cam 64 which is so formed as to vary the length of arm 55 from a maximum at the output end of conveyor 53, to a minimum at loading station 44. From arm 55 there extend radially outwards, in a direction parallel to axis 56, two tubular gripping elements 65 respectively indicated 65*a*, 65*b*, and a further two tubular gripping elements 66 respectively indicated 66*a*, 66*b*, located on either side of elements 65, and communicating, together with elements 65, with a suction pump (not shown) via an axial conduit 67 inside arm 55 and hub 57. Elements 65*a* and 66*a* are integral with portion 58, and elements 65*b* and 66*b* with portion 59. More specifically, when the length of arm 55 is maximum, the distance between the two elements 66 is equal to that between two intermediate points of wings 51 of collar 46; and the distance between the two elements 65 is approximately equal to but no less than the width of central portion 49 of collar 46, and is substantially zero when the length of arm 55 is minimum.

In addition to conveyor 53 and transfer device 54, supply device 52 also comprises two actuating devices 68 and 69 located at station 44, respectively over and beneath the path of frames 34 through station 44, and which respectively provide for moving a pusher 70 and a counterpusher 71 back and forth in a direction parallel to axis 56. Pusher 70 and counterpusher 71 provide for gripping the collar 46 fed by device 54 on to frame 34 arrested in station 44, and for transferring collar 46 into pocket 33 and into engagement with suction holes 37.

In actual use, a pair of half packets 2 arrested at unloading station 15 is transferred by pairing unit 9 into a respective pocket 16 on wheel 17 which, rotating in steps anticlockwise (in FIG. 2) about axis 18, feeds pocket 16 to station 38 in time with a pocket 33 on wheel 30; which pocket 33, by the time it reaches station 38, has already been fed in steps by wheel 30 through station 44 and supplied with a double collar 46.

Each collar 46 is fed into respective pocket 33 as follows.

Each collar 46 reaches the output end of conveyor 53 in the form of a flat blank with a number of transverse bend lines, and is positioned beneath arm 55 which is in the extended position, i.e. with tubular elements 65 over main panels 48, and tubular elements 66 over wings 51. The suction through tubular elements 65 and 66 causes the flat collar 46 to adhere to arm 55 which, when rotated about axis 56, feeds collar 46 to station 44.

Figures 3, 6:
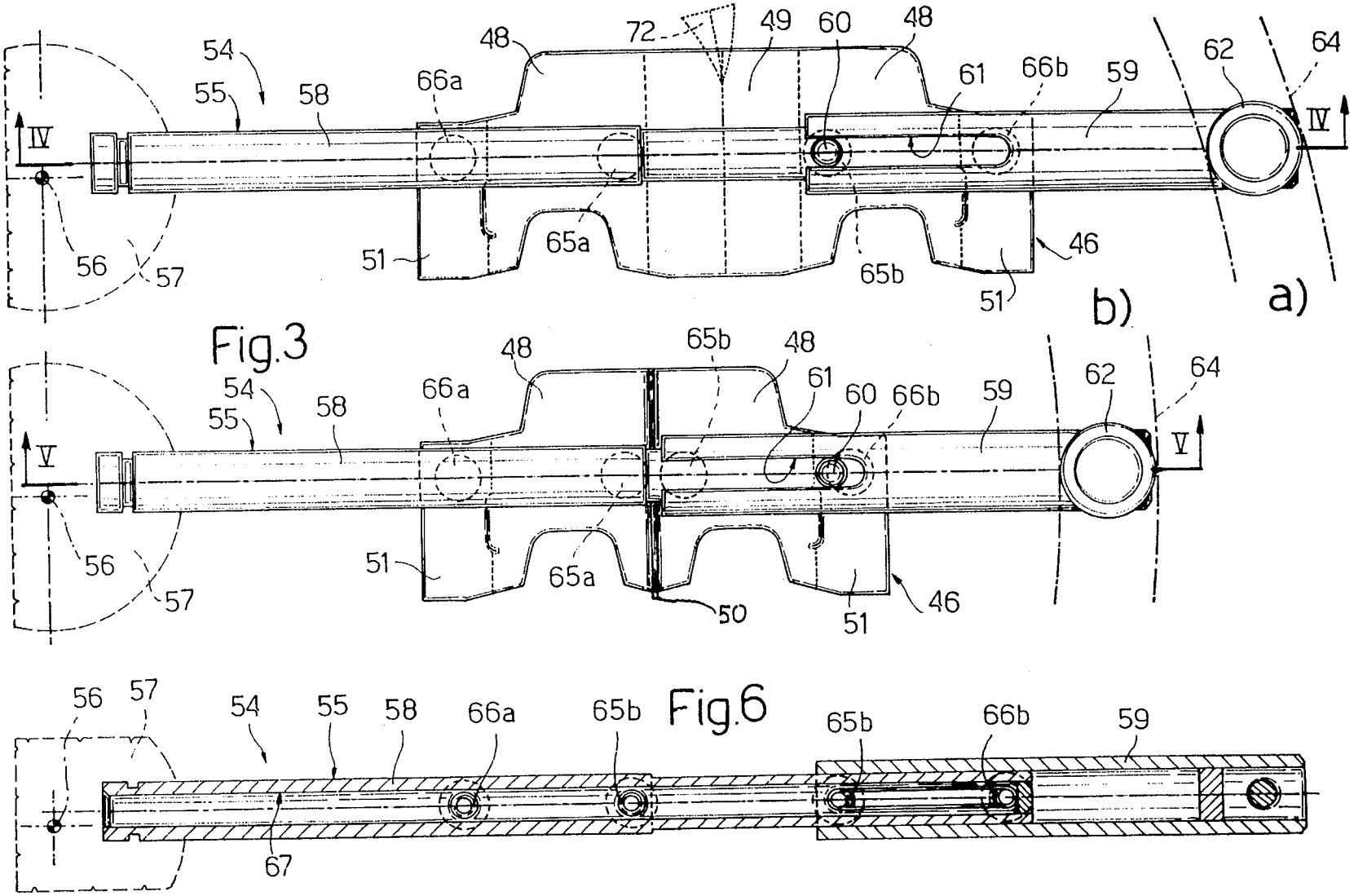
FIG. 3 shows a larger-scale view of a detail in FIG. 2 in two different operating positions.
FIG. 6 shows a section along line VI—VI in FIG. 4.

As already stated, groove 63 of cam 64 is such as to contract arm 55 as it moves towards station 44, which contraction results in tubular elements 65*a* and 65*b* coming together and so folding central portion 49 of collar 46 in accordion fashion. To ensure portion 49 is folded upwards, collar 46, as it is fed towards station 44, is fed by arm 55 over and in contact with a wedge-shaped plate 72 (FIGS. 2, 3 and 4) adjacent to the output end of conveyor 53.

At station 44, collar 46, still lying flat but with central portion 49 folded upwards in accordion fashion to define rib 50, is released by arm 55 on to respective frame 34 so that main panels 48 engage suction holes 37*a* by which collar 46 is retained in the above position pending operation of pusher 70 and counterpusher 71 which grip collar 46 by main panels 48 and feed it into respective pocket 33 so that panels 48 are detached from holes 37*a*, wings 51 are folded squarely, rib 50 is fitted on either side of partition 36, and panels 48 cooperate with holes 37.

Partition 36 substantially provides for maintaining rib 50 perfectly erect and so permitting correct insertion of a pair 8 of half packets 2 inside pocket 33 and on either side of rib 50 at station 38 where the two half packets 2 are inserted inside pocket 33 and on top of collar 46 by the combined action of pusher 42 and counterpusher 43.

The assembly 73 formed by pair 8 of half packets 2 and respective collar 46 is fed in steps by wheel 30 to station 45 where blank 47 is fed in known manner on to frame 34, and begins folding in known manner about assembly 73 as this is moved upwards by a transfer unit 74 located at station 45.

We claim:

1. A packing line for producing twin packets, each comprising two half packets (2) and a single collar (46) in turn comprising a central accordion portion (49) interposed between the two half packets (2), and two main panels (48) arranged contacting respective large lateral surfaces of the two half packets (2); the line (6) comprising folding means (54) cooperating successively with said collars (46) for so folding them, from a flat configuration, as to form said central accordion portion (49); characterized in that said folding means (54) comprise a first and second gripping member (65) comprising vacuum means for gripping the main panels (48) of a respective collar (46); and actuating means (62, 63) for moving the two gripping members (65) in relation to each other and in a given direction between a parted position corresponding to a distended configuration of said central portion (49), and an adjacent position corresponding to an accordion configuration of said central portion (49).

2. A line as claimed in claim 1, characterized in that it also comprises lead-in means (72) cooperating with said central portion (49), and for folding said central portion (49) in a given folding direction crosswise to said given direction.

3. A line as claimed in claim 1, characterized in that said folding means (54) comprise a number of said gripping members (65, 66) of which said first and second gripping members (65) are the central gripping members; said number of gripping members (65, 66) comprising a further two outer gripping members (66) located on either side of the two central gripping members (65), and each cooperating with a respective wing (51) projecting laterally from a respective said main panel (48).

4. A line as claimed in claim 3, characterized in that the outer gripping members (66) are integral one with one and the other with the other of the two central gripping members (65).

5. A line as claimed in claim 4, characterized in that said folding means (54) comprise an arm (55) in turn comprising a first and second portion (58, 59) movable in relation to each other in said given direction and respectively supporting said first (65*a*) and said second (65*b*) gripping member; said actuating means (62, 63) cooperating with one of said two portions (58, 59).

6. A line as claimed in claim 1, characterized in that said gripping members (65, 66) are pneumatic.

7. A line as claimed in claim 5, characterized in that said arm (55) comprises a swing hub (57) from which said first and second portions (58, 59) extend; the first portion (58) being integral with the hub (57); and the second portion (59) being fitted on to and movable in relation to the first portion (58) in said given direction.

8. A line as claimed in claim 5, characterized in that said actuating means (62, 63) comprise a cam (63); said second portion (59) comprising tappet means (62) cooperating with said cam (63).

9. A line as claimed in claim 1, characterized in that it comprises conveyor means (30) presenting a succession of pockets (33), each for receiving two side by side half packets (2) and a collar (46), and each movable with said conveyor means (30) in a given traveling direction through a first loading station (44) for loading the collars (46), and a second loading station (38) for loading the half packets (2); said folding means (54) being movable to and from said first loading station (44), for successively feeding the collars (46) to respective said pockets (33).

10. A line as claimed in claim 9, characterized in that each pocket (33) comprises stiffening means (36) cooperating with said central portion (49) for maintaining it in said accordion configuration; and retaining means (37) cooperating with said main panels (48) of said collar (46), for maintaining them in a given fixed position in relation to the respective central accordion portion (49).

11. A packing line for producing twin packets, the line (6) comprising first conveyor means (30) presenting a succession of pockets (33), each for receiving two side by side half packets (2) and a collar (46), and each movable with the first conveyor means (30) in a given traveling direction through a first loading station (44) for loading the collars (46), and through a second loading station (38) for loading the half packets (2); and second conveyor means (54) for successively feeding the collars (46) to the first loading station (44) and into respective said pockets (33); each collar (46) presenting a central portion (49) foldable accordion-fashion and insertable between two respective half packets (2) , two main panels (48) which are positioned contacting respective large lateral surfaces of the two half packets (2), and two outer lateral wings (51) which are folded squarely in relation to the respective main panels (48) and on the same side of the main panels (48) as the central portion (49); the line (6) being characterized in that said second conveyor means (54) comprise a conveyor element (55) movable through the first loading station (44) in time with a respective said pocket (33), and comprising two central gripping members (65) comprising vacuum means for gripping the main panels (48) of a respective collar (46), and actuating means (62, 63) for moving the two central gripping members (65) in relation to each other and in a given direction between a parted position corresponding to a distended configuration of said central portion (49) , and an adjacent position corresponding to an accordion configuration of the central portion (49).

12. A line as claimed in claim 11, characterized in that each said pocket (33) comprises stiffening means (36) cooperating with said central portion (49) for maintaining it in said accordion configuration; and retaining means (37) cooperating with said main panels (48) of said collar (46), for maintaining them in a given fixed position in relation to the respective central accordion portion (49).

13. A line as claimed in claim 11 characterized in that said conveyor element (55) also comprises a further two outer gripping members (66) located on either side of the two central gripping members (65) and each cooperating with a respective said lateral wing (51); the outer gripping members (66) being integral one with one and the other with the other of said two central gripping members (65).

14. A line as claimed in claim 11, characterized in that said conveyor element (55) comprises a swing hub (57); a first portion (58) integral with the swing hub (57) and extending from the hub (57) in said given direction; and a second portion (59) fitted on to and moved in relation to the first portion (58) in said given direction by said actuating means (62, 63) as the conveyor element (55) travels along a given path to and from the first loading station (44).

15. A line as claimed in claim 14, characterized in that said actuating means (62, 63) comprise fixed cam means (63) extending along said path; and tappet means (62) cooperating with said cam means (63) and fitted to said second portion (59).

16. A line as claimed in claim 14, characterized in that it also comprises lead-in means (72) located along said path and cooperating with said central portion (49) for folding the central portion (49) in a given folding direction crosswise to said given direction.

17. A line as claimed in claim 11, characterized in that said gripping members (65, 66) are pneumatic.

* * * * *